US005085002A

United States Patent [19]

Lee et al.

[11] Patent Number: 5,085,002

[45] Date of Patent: Feb. 4, 1992

[54] PORTABLE ART OBJECT WALL DECORATION

[76] Inventors: Jer-Shyang J. Lee, 8733 Carrollwood Cv. N.; Shin Y. Lee, 8729 Carrollwood Cv. N., both of Cordova, Tenn. 38018

[21] Appl. No.: 587,332

[22] Filed: Sep. 24, 1990

[51] Int. Cl.[5] ..... A01G 5/00

[52] U.S. Cl. ..... 47/41.12; 47/41.01; 47/83; 47/66

[58] Field of Search ..... 47/41.12, 41.13, 41.15, 47/41.11, 41.01, 41.1, 83, 66

[56] References Cited

U.S. PATENT DOCUMENTS

| | | | |
|---|---|---|---|
| D. 96,435 | 7/1935 | Weil | 47/41.01 |
| 338,845 | 3/1886 | Kift | 47/41.01 |
| 2,217,454 | 10/1940 | Pfeiffer | 41/34 |
| 2,312,007 | 2/1943 | Thrasher | 40/160 |
| 2,686,988 | 8/1954 | Garber | 47/41.01 |
| 2,887,824 | 5/1959 | Riva | 206/423 |
| 3,553,888 | 6/1971 | Daly | 47/41.01 |
| 3,879,891 | 4/1975 | Jones | 206/423 |
| 4,004,367 | 1/1977 | O'Connell | 47/41.12 |
| 4,584,213 | 4/1986 | Rentowl | 428/23 |
| 4,840,275 | 6/1989 | Faiola | 206/459 |
| 4,917,240 | 4/1990 | Roberts et al. | 206/232 |

FOREIGN PATENT DOCUMENTS

| | | | |
|---|---|---|---|
| 782613 | 6/1935 | France | 47/41.01 |
| 21990 | of 1914 | United Kingdom | 47/41 |
| 2065059 | 6/1981 | United Kingdom | 206/423 |

*Primary Examiner*—Henry E. Raduazo
*Attorney, Agent, or Firm*—Walker & McKenzie

[57] ABSTRACT

A portable art object wall decoration. The art object wall decoration includes a frame for hanging on the wall and which can be moved as desired. There is a mat which is attached to the frame, and a container which is supported from the frame on the front side of the mat. The container has a cavity and an uncovered opening accessible from the outside of the art object wall decoration and communicating with the cavity for receiving a portion of an art arrangement in the cavity through the opening with the art arrangement being accessible for the changing thereof if desired.

5 Claims, 1 Drawing Sheet

PORTABLE ART OBJECT WALL DECORATION

BACKGROUND OF THE INVENTION

1. Field of the Invention. The present invention relates, in general, to a portable or moveable wall decoration.

2. Information Disclosure Statement: A preliminary patentability search conducted in Class 40, subclass 160, class 47, subclass 41.12, and class 206, subclass 423 produced the following patents: Pfeiffer, U.S. Pat. No. 2,217,454; Thrasher, U.S. Pat. No. 2,312,007; Rentowl, U.S. Pat. No. 4,584,213; Faiola, U.S. Pat. No. 4,840,275; and Roberts et al., U.S. Pat. No. 4,917,240.

Pfeiffer '454 discloses a greeting card device including a card having a flower or bouquet of flowers attached thereto.

Thrasher '007 discloses a display article and method of manufacturing same. The display article includes a supporting frame enabling it to be attached to a wall or the like, and includes a floral display attached to a sheet behind a glass member.

Rentowl '213 discloses a commemorative card formed from water impervious or water resistant material and is provided with means for mounting at least one fresh or artificial flower thereon.

Faiola et al.'275 discloses a greeting card and package including a removable, transparent receptacle for a gift such a flower.

Roberts et al.'240 discloses an expandable floral greeting card which includes an expandable base and a face card attached to the base for displaying a decorative greeting or statement and a floral arrangement.

SUMMARY OF THE INVENTION

The present invention is directed towards providing a portable or moveable art object wall decoration that can be taken off the wall and hung in another location, if desired.

One of the objects of the present invention is to provide a portable art object decoration that is versatile whereby if desired the art object decoration can be changed as desired.

A further object is to provide such an art object decoration that includes an efficient and sturdy means for supporting the art arrangement without detracting from the appearance thereof.

A further object is to provide a portable wall decoration which provides an attractive and realistic three dimensional appearance.

The art object wall decoration of the present invention in general comprises, in combination:

An art object wall decoration having a front side and a rear side for hanging on a wall with said front side facing outwardly and said rear side being adjacent the wall upon which hung, said art object wall decoration comprising a frame means for hanging on a wall and for being moved to a new location if desired, said frame means defining an open space; a mat fixedly attached to said frame means and extending across said open space, said mat having a front side and a back side; a container having a cavity and an uncovered opening accessible from the outside of said art object wall decoration and communicating with said cavity for receiving a portion of an art arrangement in said cavity through said opening with the art arrangement being accessible for the changing thereof if desired; and supporting means attached to said container and said frame means for supporting said container from said frame means on the front side of said mat.

DESCRIPTION OF THE PREFERRED EMBODIMENT

Figure 1:
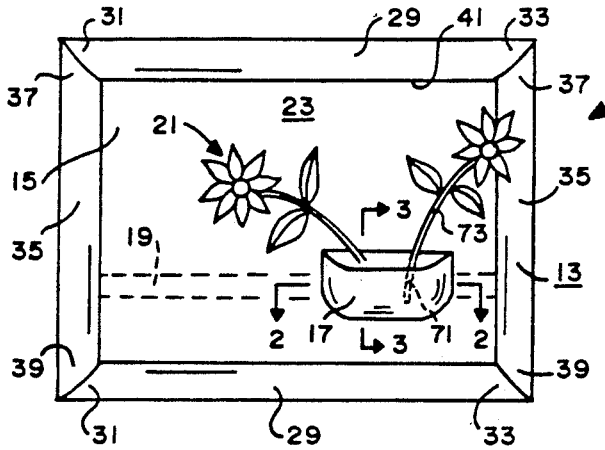
FIG. 1 is a front elevational view of the art object wall decoration of the present invention.

The art object decoration 11 of the present invention includes in general a frame 13, a mat 15, a container 17, and a container decor or art arrangement 21.

Figure 4:
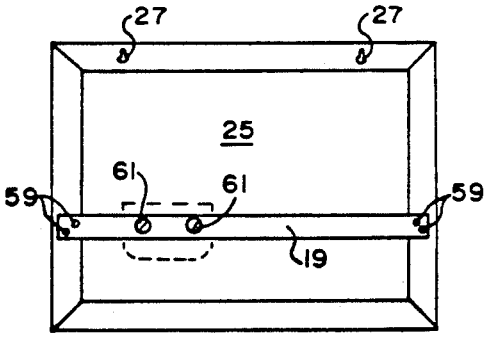
FIG. 4 is a rear elevational view of the art object wall decoration of the present invention.

Art object wall decoration 11 includes a front side 23 as viewed in FIG. 1 and a rear side 25 as viewed in FIG. 4. Art object wall decoration 11 includes hanging means such as hangers 27 attached to rear side 25 of art object wall decoration 11, for hanging art object wall decoration 11 from a wall W with the back side 25 being adjacent wall W and front side 23 facing outwardly, similar to the manner in which a picture is hung from a wall. It will be understood that hangers 27 are of the type well known to those skilled in the art which permit art object wall decoration 11 to be taken off the wall W and hung in another location as desired.

Frame 13 includes a pair of spaced and parallel horizontal frame members 29 each having a first end 31 and a second end 33. Also, frame 13 includes a pair of spaced and parallel vertical frame members 35 each having an upper end 37 and a lower end 39 respectively fixedly joined to said first and second ends 31, 33 of horizontal frame members 29 by suitable means, such as nails, glue or the like, now well known to those skilled in the art. Frame 13 may be constructed of any suitable material such as wood, acrylic, ceramic, metal, etc. and may be of any desired size. Frame 13 is an open frame which has a central open space 41 around which horizontal and vertical frame members 29,35 extend.

Mat 15 may be constructed of any suitable material such as wood, ceramic, plastic, laminated material, paper, etc. with the dimensions thereof matching the dimensions of frame 13. Mat 15 preferably covers the entire central open space 41 in frame 13 and is fixedly attached adjacent the periphery thereof to frame 13 preferably by suitable means, such as nails or the like, not shown, in the manner that mats are attached to picture frames as is known to those skilled in the art. Mat 15 includes a front side 43 and a back side 45. If desired front side 43 may be decorated as by painting, etc.

Figure 2:
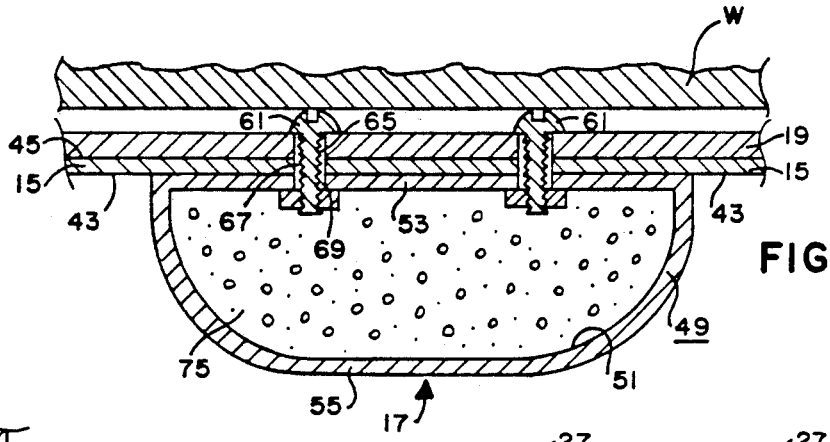
FIG. 2 is an enlarged sectional view taken as on line 2—2 of FIG. 1, with the art arrangement removed.
Figure 3:
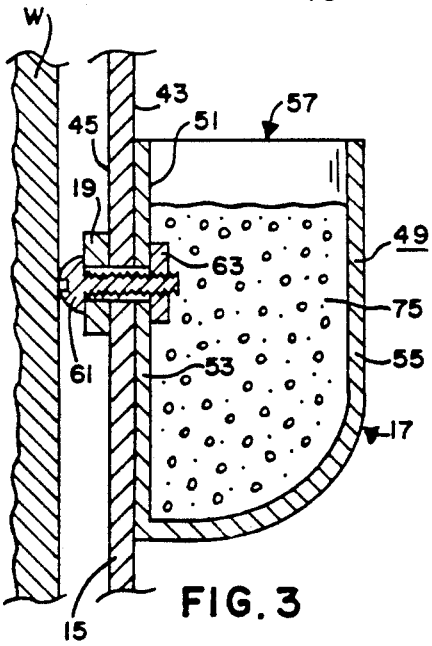
FIG. 3 is an enlarged sectional view taken as on line 3—3 of FIG. 1, with the art arrangement removed.

Container 17 preferably includes wall means 49 extending completely around the periphery of container 17 to define a cavity 51 in the interior of the container. Wall means 49 preferably includes a flat back wall 53 as seen in FIGS. 2 and 3, and a rounded wall 55 integrally attached to back wall 53 providing the front, bottom, and side portions of the remainder of the container 17 establishing cavity 51. Also, container 17 has an upwardly facing uncovered opening 57 communicating cavity 51 with the outside environment so as to provide access to cavity 51 from the outside of art object wall decoration 11 whereby the art arrangement 21 can be easily and quickly changed by person without a disassemblying the art object wall decoration 11, as will be better understood in the description to follow later in the specification. Other than opening 57 the container 17 is preferably closed so that, for example, water may be held in the cavity 51. Also, container 17 may be formed of a suitable material, as for example, metal, and may be in a suitable form, such as in the form of a basket.

Mounting bracket 19 is fixedly mounted on frame 13 by suitable means well known to those skilled in the art, such as screws 59 extending through openings, not shown, in mounting bracket 19 and into frame 13. Mounting bracket is preferably in the form of a horizontal bar extending across the back of frame 13 and behind mat 15 adjacent the back side thereof and preferably out of sight when art object wall decoration 11 is viewed from the front thereof.

Fastening means of any suitable construction well known to those skilled in the art such as bolts 61 and nuts 63 are provided for fastening container 17 to mounting bracket 19 whereby container 17 is removably supported from frame 13. Bolts 61 respectively extend through apertures 65 in mounting bracket 19, through apertures 67 in mat 15, and apertures 69 in wall 53. Nuts 63 are preferably respectively threadedly engaged on bolts 61 on the inner side of wall 53 to retain bolts 61 in place. However, if desired nuts 63 may be omitted and the bolts simply threaded into threaded apertures in wall 53. Also, if desired other fastening means such as wires, screws or the like, may be utilized in place of bolts 61 and nuts 63.

Art arrangement 21 has a lower portion 71 and an upper portion 73. Art arrangement 21 is supported by container 17 with the lower portion 71 extending through opening 57 into cavity 51 and with upper portion 73 extending out of the container and being visible when art object decoration 11 is viewed from the front or the sides thereof. Thus, art arrangement 21 is accessible from the outside of art object decoration 11 for the changing of the art arrangement, if desired, without having to remove front covers, such as would be the case if glass, plastic covers or the like were provided over the front of container 17 and mat 15. Art arrangement 21 may be constructed of any type of arrangement that is of artistic appeal, as for example, flower arrangements either real flowers or artificial, silk, wood, paper, metal, etc.

If desired a piece of plastic 75 or the like may be provided in cavity for holding the lower portion 71 of art arrangement 21, as for example, by sticking the lower end of flower stems into the plastic 75 which is preferably a soft foam type now well known to those skilled in the art.

Figure 5:
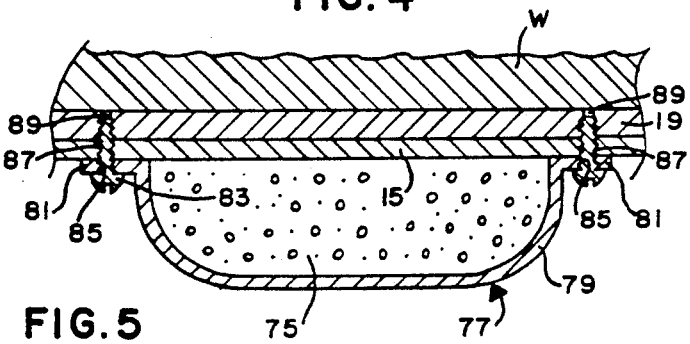
FIG. 5 is a sectional view similar to FIG. 2 of a modified embodiment of the container of the present invention and the mounting means therefor.

A modified embodiment of the container is shown as at 77 in FIG. 5 wherein it will be seen that if desired the flat back wall of the container has been omitted and only the rounded wall 79 is provided which corresponds and is substantially identical to the rounded wall 55 of container 17. In other words, the wall of container 77 is interrupted adjacent mat 15 and container 77 includes a pair of flanges 81 extending laterally outward from wall 55. Fastening means preferably in the form of bolts 83 respectively extend through apertures 85 in flanges 81, through apertures 87 in mat 15, and into threaded apertures 89 in mounting bracket 19. If desired bolts 83 may extend through the apertures 89 and be provided with nuts, not shown, on the back side of bracket 19. Other than the differences mentioned in this paragraph containers 17 and 77 are substantially identical.

It should be pointed out that if mat 15 is of sufficiently strong construction, mounting bracket 19 may be omitted, and containers 17 and 77 may be supported from frame 13 by mat 15, with the containers fixedly attached to the mat by suitable means, as for example, by bolts, glue or the like.

In the use of the art object wall decoration 11, it will be understood that the art arrangement 21 may be changed, as for example, for different seasons, holidays etc. and with a minimum amount of effort by the user. Also, containers 17 and 77 may be changed. In addition, it will be understood that the art arrangement is portable and the location thereof ma be changed as desired.

Although the present invention has been described and illustrated with respect to a preferred embodiment and a preferred use therefor, it is not to be so limited since modifications and changes can be made therein which are within the full intended scope of the invention.

We claim:

1. An art object wall decoration having a front side and a rear side for hanging on a wall with said front side facing outwardly and said rear side being adjacent the wall upon which said art object wall decoration is hung, said art object wall decoration comprising:

a) a frame means for hanging on a wall and for being moved to a new location if desired, said frame means defining an open space;

b) a mat fixedly attached to said frame means and extending across said open space, said mat having a front side and a back side;

c) a container having a cavity and an uncovered opening accessible from the front side of said art object wall decoration and communicating with said cavity for receiving a portion of an art arrangement in said cavity through said opening with the art arrangement being accessible for the changing thereof if desired;

d) supporting means for supporting said container from said frame means with said container being supported on the front side of said mat, said supporting means including a mounting bracket fixedly mounted on said frame behind said mat adjacent said back side of said mat and out of sight when the art object wall decoration is viewed from the front thereof, and fastening means attached to said container, extending through said mat, and attached to said bracket means for supporting said container from said frame; and e) an art arrangement having a lower portion and an upper portion, said art arrangement being supported by said container with said lower portion thereof extending through said opening in said container into said cavity and with said upper portion of said art arrangement extending out of said container and accessible for the changing of said art arrangement as desired.

2. The art object wall decoration of claim 1 which includes plastic means disposed in said cavity for holding said lower portion of said art arrangement.

3. An art object wall decoration having a front side and a rear side for hanging on a wall with said front side facing outwardly and said rear side being adjacent the wall upon which said art object wall decoration is hung, said art object wall decoration comprising:

a) a frame including a pair of spaced horizontal frame members each having a first end and a second end, and a pair of spaced vertical frame members each having an upper end and a lower end respectively joined to said first and second ends of said horizontal frame members to define a open frame having a central open space around which said horizontal and vertical members extend;

b) a mat fixedly attached to said frame and extending across said open space, said mat having a front side and a back side;

c) a mounting bracket fixedly mounted on said frame behind said mat adjacent said back side of said mat and out of sight when said art object wall decoration is viewed from the front thereof;

d) a container having a cavity and an opening communicating with said cavity, said container being disposed on said front side of said mat;

e) fastening means attached to said container, extending through said mat, and attached to said mounting bracket for supporting said container from said frame; and f) an art arrangement having a lower portion and an upper portion, said art arrangement being supported by said container with said lower portion thereof extending through said opening in said container into said cavity and with said upper portion of said art arrangement extending out of said container and being visible when said art object wall decoration is viewed rom the front or sides thereof.

4. The art object wall decoration of claim 3 in which said art arrangement comprises an arrangement of flowers.

5. The art object wall decoration of claim 3 which includes plastic means disposed in said cavity for holding said lower portion of said art arrangement.

* * * * *